US005347946A

United States Patent [19]

Puckett

[11] Patent Number: 5,347,946

[45] Date of Patent: Sep. 20, 1994

[54] STRUCTURE FOR AERODYNAMIC TRANSITION BETWEEN MAST AND SAIL IN A SAILCRAFT

[75] Inventor: Lawrence J. Puckett, Churchville, Md.

[73] Assignee: The United States of America as represented by the Secretary of the Army, Washington, D.C.

[21] Appl. No.: 157,457

[22] Filed: Nov. 26, 1993

[51] Int. Cl.[5] ..... B63B 15/00

[52] U.S. Cl. ..... 114/90; 114/102

[58] Field of Search ..... 114/39.1, 39.2, 102, 114/103, 104, 1.5, 106, 107, 108, 89, 90, 91

[56] References Cited

U.S. PATENT DOCUMENTS 4,064,821 12/1977 Roberts, Jr. et al. ..... 114/102
4,369,726 1/1983 Mader ..... 114/108
4,690,088 9/1987 Perini ..... 114/108
4,972,789 11/1990 Greppi ..... 114/102
5,109,787 5/1992 Peterson ..... 114/102

*Primary Examiner*—Stephen P. Avila
*Attorney, Agent, or Firm*—Freda L. Krosnick; Muzio B. Roberto

[57] ABSTRACT

Sail structure for sailcraft for improved air flow transition from the sailcraft mast. Several embodiments are provided in which a pair of sail luff panels are maintained in close proximity to aft portion of the mast. In a first and second embodiment, inflatable tubular inserts which slidably mate with the bolt rope groove of the mast are provided. In third and fourth embodiments, stackable and keyed inserts which engage the bolt rope groove are provided. In fifth and sixth embodiments, bolt rope tracks or grooves are provided in the mast for maintaining the position of the luff panels.

8 Claims, 3 Drawing Sheets

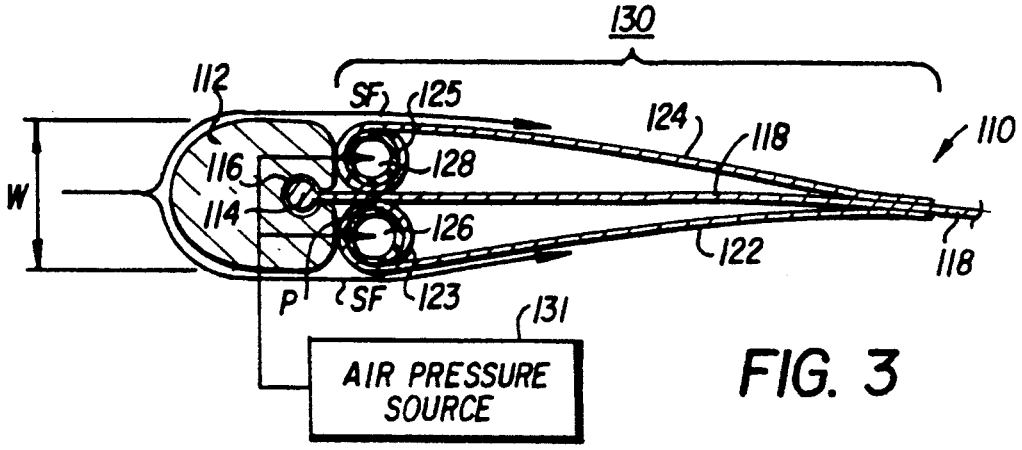
FIG. 3
FIG. 4
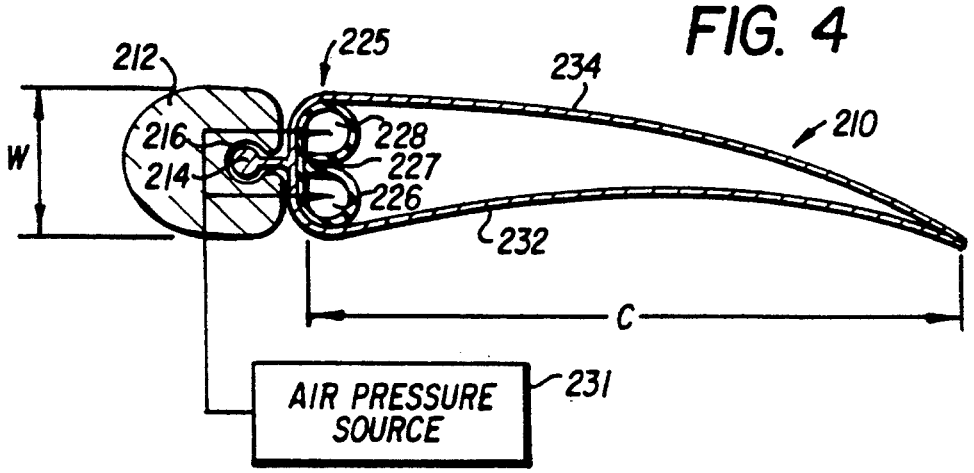
FIG. 5
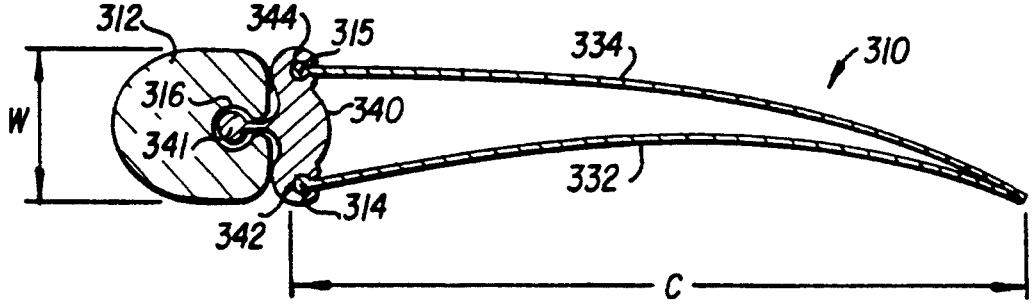

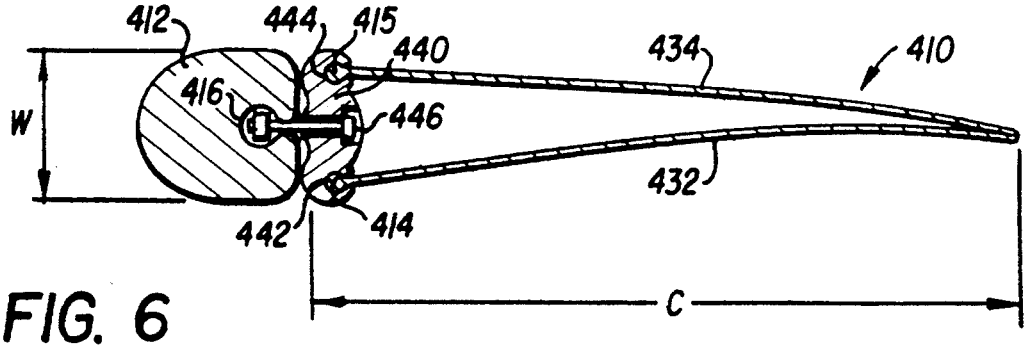
FIG. 6
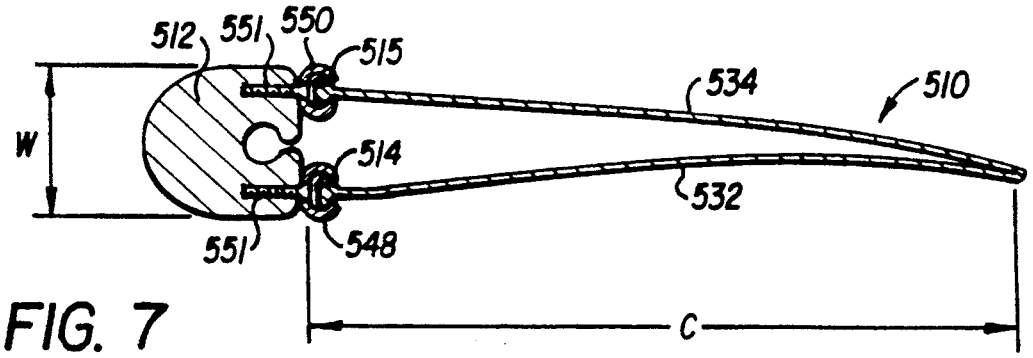
FIG. 7
FIG. 8
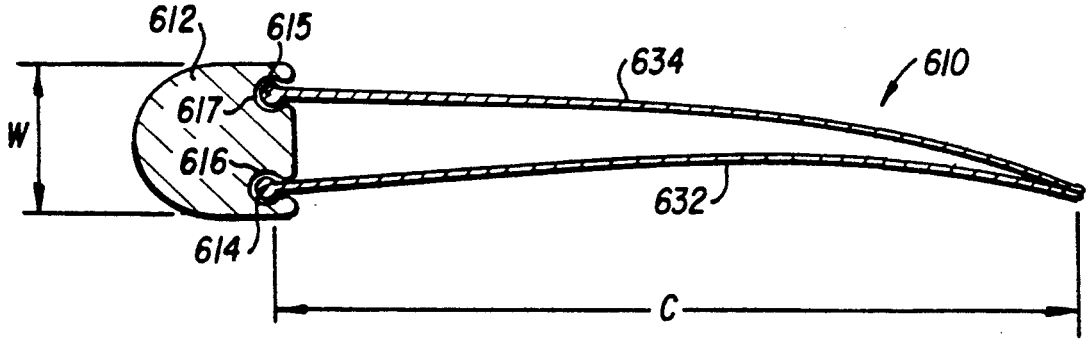

STRUCTURE FOR AERODYNAMIC TRANSITION BETWEEN MAST AND SAIL IN A SAILCRAFT

FIELD OF THE INVENTION

The present invention is directed to a sail structure for a sailboat or sailcraft which provides a modification of conventional sail design in order to retain the conventional mast and rigging design, while mitigating the negative lift-to-drag influence of the mast on the sail.

BACKGROUND OF THE INVENTION

Contemporary sailing vessels employ semi-rigid, structural mast spars to support aloft the sail plan. Due to the mast cross-sectional dimensions necessary to support the compressional forces exerted on the mast by the rigging which holds the mast erect, a large dimensional reduction is presented to the air as it flows over the mast section and onto the thin membrane airfoil (sail). This large change in dimension from the mast to the sail surface causes the air stream to separate into turbulent eddies on the downstream side of the mast. The turbulence is sufficiently large as to cause a "separation bubble" to form along the leading edge, or luff, of the sail. The separation bubble increases the air drag on the sail and diminishes the surface area of the sail that experiences attached airflow (both laminar and turbulent) from which the greatest aerodynamic lift is obtained. Thus, the necessary presence of the mast, from a structural perspective, produces a negative influence on the lift-to-drag characteristics of the sail attached thereto.

Prior art approaches to solving this problem include designs which physically remove the mast from the vicinity of the sail, but those approaches suffer from extra structural weight and windage. Another approach which uses a "wrap-around-the-mast" soft (thin membrane) sail works only with masts not requiring spreaders and shrouds in the rigging; thus, it is unsuitable for medium-to-large high-performance vessels. Finally, some high-performance vessels have exploited rigid wings, also known as "hard sails." Hard sails work well, but are very expensive to fabricate and maintain, and they pose substantial problems for the vessel when not underway. Although the prior art does address the same problem, the solutions of the prior art involve complex and expensive designs appropriate to a small fraction of recreational sailing vessels. Most notably, as described below, inflatable sails and bags are employed, which require considerable alteration of the sail and/or mast.

Exemplary of the prior art, U.S. Pat. No. 3,132,620 to Court discloses a sailboat having alternative sail designs. In a first embodiment of a sail with two inflatable luff pockets, inflatable spaces are provided between the mainsail and two fairing sections each attached to opposite sides of the mainsail. The mainsail and each fairing section are attached to a rotatable mast bolt rope which engages bolt rope grooves in the mast. In a second embodiment, a fixed mast is provided with a double luff sail, each luff running around the mast to a slot near the front of the mast.

U.S. Pat. No. 4,753,186 to Paras is directed to a sailboat sail having sail panels which are wrapped around the mast. An inflatable bag having a sleeve is positioned within the panels with the sleeve over the mast.

U.S. Pat. No. 3,391,668 to Birchill is directed to a sail having a sealed chamber of lightweight flexible material extending along the leading edge portion, with an air inlet at the head of the sail. The chamber is inflatable by ram air entering the inlet. The chamber may be fitted around the mast or alternatively attached by a bolt rope to a bolt rope groove in the mast.

U.S. Pat. No. 4,947,776 to Peterson discloses an aerodynamically shaped fairing which fits around a sailboat headsail forestay. The fairing has a bolt rope groove for engaging the sail bolt rope at the leading edge of the head sail. An internal cavity is provided for pivotally carrying a toggle member which engages the forestay. A pair of inflatable tubes are disposed on opposite sides of the toggle member and are inflated selectively so as to flip the toggle member from side to side, thereby providing optimum leading edge camber of the sail on both port and starboard tacks.

U.S. Pat. No. 4,741,282 to Duke discloses an inflatable sail having either two outer sailcloth sides or panels or two outer panels and an inner panel, with inlet vents and outlet vents by which the airspace between the sailcloth sides is inflated by the wind.

U.S. Pat. No. 3,866,558 to Bergstrom et al. discloses a specific non-circular mast cross-section, having projections on the surface thereof a wedge-shaped enlarged slot on the rear thereof for receiving the luff edge of the sail. This patent shows and describes problems in airflow and flow separation.

The prior art also shows various approaches to airfoil improvement in sails, to wit:

U.S. Pat. No. 4,593,638 to Cochran et al. is directed to semi-rigid flexible profile members which fit around the mast. A profile sleeve formed in the sail is fitted over the profile members to form an aerodynamic wing-profile shape.

U.S. Pat. No. 4,479,451 to Lucht teaches a sail having a tubular air envelope portion at the front of the sail for running on a mast stay. A plurality of telescoping contour sleeves are disposed in the tubular portion to sheath the mast or stay when the envelope portion is run on the mast or stay.

U.S. Pat. No. 4,879,961 to Aguilera is directed to an inflatable airfoil device for extending over a substantial portion of an existing sail.

U.S. Pat. No. 4,803,939 to Jones discloses a slot-forming foil for mounting in front of the mast of a sailboat.

U.S. Pat. No. 4,785,757 to Östholm is directed to an apparatus for stretching sails, which includes inflatable fluid-tight containers horizontally mounted at various elevations on the sail.

U.S. Pat. No. 4,646,671 to Innes et al. is directed to an airfoil for improving airflow past the leading edge of a sail, such as a headsail, by presenting a thick or relatively wide leading edge of the sail. For use in a headsail, the apparatus would not be mounted in the vicinity of the mast.

U.S. Pat. No. 4,388,888 to Gushurst, Jr. is directed to an adjustable airfoil and shows an aerodynamically shaped vane mounted on a mast which cooperates with luff slot flaps to make a smooth transition to flexible semi-rigid sail panels.

It should be noted that none of the inflatable prior art devices uses a relatively small inflatable tubular structure to support and maintain separation of luff panels in the vicinity of the aft portion of the mast. Rather, extensive inflatable bags, resulting in considerable sealing problems are used. Similiarly, inserts which do not require inflation are not taught by the prior art devices.

SUMMARY OF THE INVENTION

The present invention is directed to mitigating the negative lift-to-drag influence of the mast and, in so doing, sets forth a modification of conventional sail design in order to retain the conventional mast and rigging design. The present invention is directed to several alternative embodiments intended to accomplish such modification.

A first embodiment is comprised of an inflatable luff of the sail attached to the mast. This embodiment includes the standard sail luff attachment and retains the strength of the standard design. To that standard design is attached (as by sewing) a second fabric (sailcloth) in such a way that it is joined to the original sail material near the point of attachment to the bolt rope, which slides in a retaining groove on the aft-facing surface of the mast. At the point of attachment, on each side of the standard sail luff, the second fabric is formed into a hollow tube of diameter approximately equal to half the mast diameter. From that point, the second fabric extends aft along both sides of the standard sail to a distance approximately 30% to 50% of the chord length, where it is attached to the standard sail. Inflatable tubes are inserted into the tubes formed from the second fabric. When those tubes are inflated, they cause the second fabric to expand away from the standard sail luff, thus forming a new "thickened sandwich" luff, the new "thickened" dimension of which is approximately equal to, or somewhat larger than, the mast thickness (transverse width) dimension.

In this manner, by expanding the transverse width dimension of the sail, the large dimensional change that the mast and standard sail present to the airflow has been largely eliminated. Furthermore, this shape change, which facilitates airflow attachment to the luff portion of the sail, enhances the forward drive of the aerodynamic forces acting on the sail.

A second embodiment employs the same concept of an inflatable luff, but provides for additional tuning flexibility. In this second embodiment, a single, somewhat larger inflatable tube is used. The standard sail luff is removed, however, and the second fabric, which wraps around the tube and forms a hollow envelope, replaces the standard luff. In this embodiment, the inflatable tube is creased down its longitudinal (vertical) axis, and attached at the crease to the second fabric at the bolt rope. From this point of attachment, the new fabric envelope may be extended aft to comprise the entire sail area.

The advantage of the second embodiment is that the tube may be inflated to achieve greater dimensions, without the constrictions of the standard luff construction of the first embodiment. This feature may be of advantage in tuning the luff dimension to match the mast and airstream for a greater range of sailing conditions.

Four additional alternative embodiments eliminate the inflatable air tubes required to expand the luff thickness or width to match that of the mast. In addition, the standard luff is eliminated and replaced by two luff panels forming a hollow envelope. The third through sixth alternative embodiments each feature a double bolt rope track and a sail modified to include a double (separated) luff each with its own bolt rope.

The double bolt rope track is accomplished in any one of four ways. The third embodiment uses rigid, or semi-rigid, segmented inserts designed to fit into the standard bolt rope track, where the segments are stacked, end to end, and keyed together to form a continuous double track for the double luffed sail. The fourth embodiment uses a single piece double bolt rope track or insert, which is semi-permanently attached to the aft face of the mast, with fasteners to the standard bolt rope track. The fifth embodiment uses two separate, additional, bolt rope tracks attached, one to either side of the aft face of the standard mast. The double luffed sail having dual ropes is attached to the tracks. An advantage of the latter design is that the original bolt rope track remains available for use in the absence of a double luffed sail. The sixth embodiment uses a mast designed to provide the double bolt rope track, much as the standard mast provides a single bolt rope track.

With the foregoing and other advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 3 is a sectional view of a sail and mast in accordance with a first embodiment of the invention;

FIG. 4 is a sectional view of a sail and mast in accordance with a second embodiment of the invention;

FIG. 5 is a sectional view of a sail and mast in accordance with a third embodiment of the invention;

FIG. 6 is a sectional view of a sail and mast in accordance with a fourth embodiment of the invention;

FIG. 7 is a sectional view of a sail and mast in accordance with a fifth embodiment of the invention; and FIG. 8 is a sectional view of a sail and mast in accordance with a sixth embodiment of the invention.

DETAILED DESCRIPTION OF THE INVENTION

Figure 1:
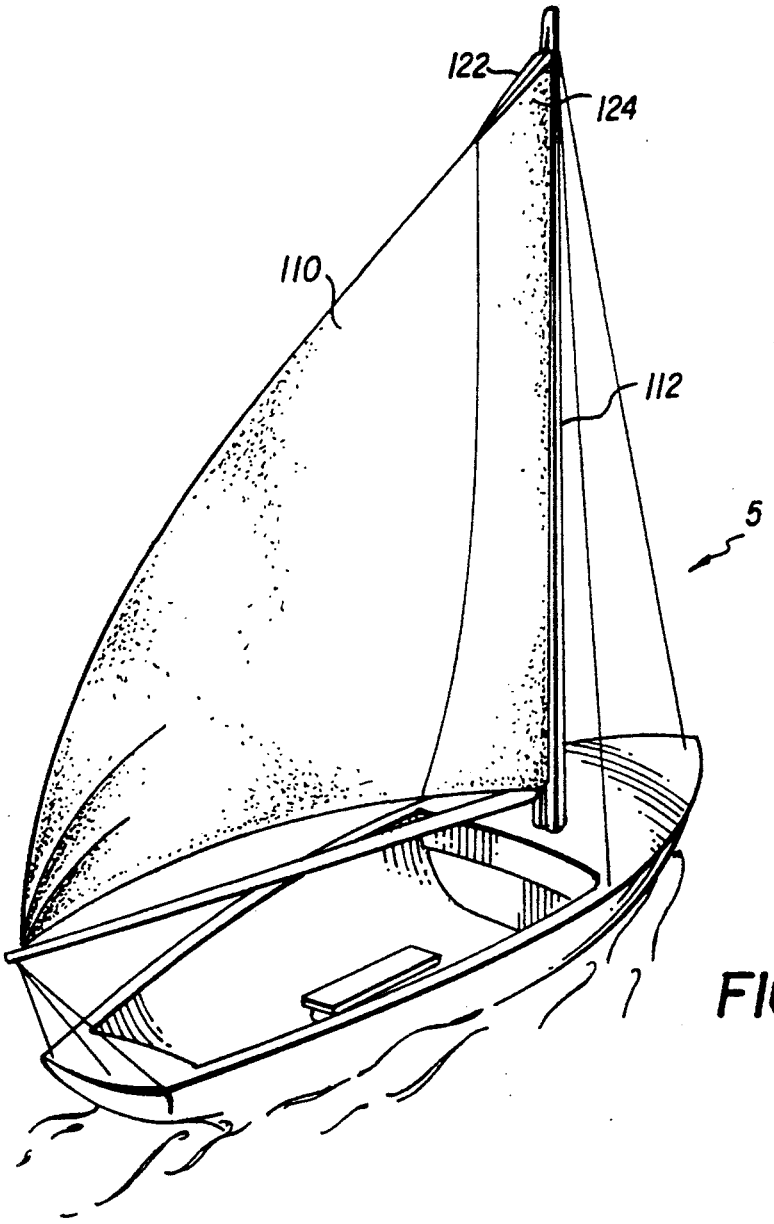
FIG. 1 is a perspective view of a sailboat having a sail in accordance with a first embodiment of the invention.

Referring now in detail to the drawings wherein like parts are designated by like reference numerals throughout, there is illustrated in FIG. 1 a perspective view of a sailboat 5 (or other sailcraft) having a sail structure 110 and mast 112 according to a first embodiment of the invention. The alternative embodiments described herein can also be mounted on such a sailboat 5.

Figure 2:
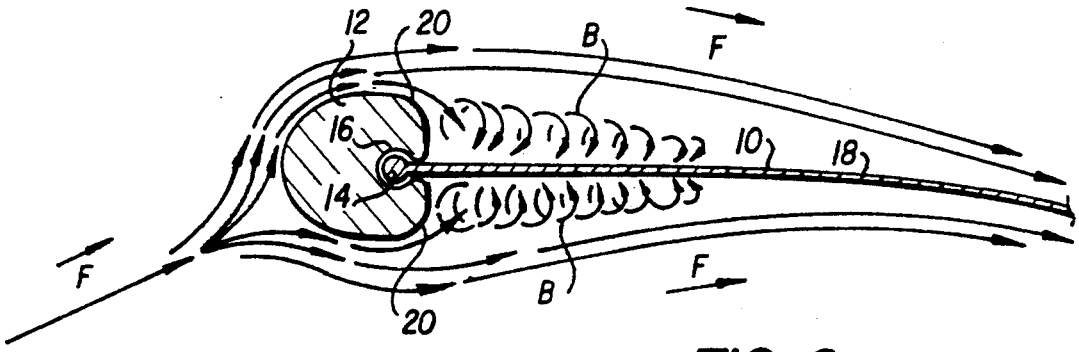
FIG. 2 (PRIOR ART)
FIG. 2 is a sectional view of a prior art sail and mast showing airflow patterns about the mast and sail.

FIG. 2 shows a sectional view of a conventional prior art mast and sail configuration. As shown therein, a sail 10 is engaged with a mast 12 by means of a conventional bolt rope 14 attached at the leading edge of the sail 10 and captured within bolt rope groove 16 in the aft side of mast 12. The bolt rope 14 is slidably engaged within mast rope groove 16 so as to permit sail 10 to be hoisted and lowered, as is known in the art. As depicted in FIG. 2, conventional sail 10 is a single membrane 18. The consequence of this standard mast-sail configuration is that there is a transition from the blunt or wide body of the mast 12 to a narrow or thin body of the sail membrane 18 as shown in the airflow direction designated by arrow F. As a result of this flow transition, there is a flow separation near the trailing (aft) edges 20 of the mast 12. This results in flow separation bubbles B having turbulent eddies which comprise the flow in the vicinity of the sail membrane 18. These flow separation bubbles B have a negative effect on the lift-to-drag characteristics of the sail 10.

FIG. 3 shows a sectional view of a first embodiment of a sail and insert for overcoming the problems associated with flow separation and turbulence as depicted in FIG. 2. Mast 112 is provided, having bolt rope groove 116 therein for engaging with bolt rope 114 of a standard sail 110 having sail membrane 118. Two additional fabric portions designated 122, 124 are provided on either side of sail membrane 118 and are formed into sleeves 123, 125 each approximately equal in diameter to half the mast transverse width W. Fabric portions 122, 124 are fastened to sail membrane 118 by sewing or other suitable means and extend from a fastening point P near the mast 112 to a distance of approximately 30–50% of the chord length of the sail membrane. Inflatable tubes 126, 128 are each held between sail membrane 118 and fabric portions 122, 124 respectively by the sleeves 123, 125. When inflated, inflatable tubes 126, 128 cause the sleeves 123, 125 of fabric portions 122, 124 to extend for the transverse width W of mast 112. This results in a tapered and converging section of sail 110, designated 130. Instead of flow separation occurring on the aft side of mast 112, streamlined flow SF continues along the sail section 130 to the sail membrane 118. Tubes 126, 128 are inflated by a source of air pressure 131, as is known in the art.

FIG. 4 shows a sectional view of a second embodiment of a sail and insert, similar to the first embodiment. Again, mast 212 having bolt rope groove 216 engages with bolt rope 214 of a sail structure 210. A single inflatable tube 225 is creased along line 227 to form two inflatable chambers 226, 228 which are captured within and attached to sail membranes 232, 234 along crease 227 adjacent bolt rope 214. However, in this embodiment, there is no intermediate sail membrane corresponding to sail membrane 118. Rather, sail membranes 232, 234 extend the entire cord length C of sail structure 210. When inflated by air pressure source 231, inflatable chambers 226, 228 extend the membranes transversely to the width W of mast 212, so that flow separation is avoided by providing a smooth transition from mast 212 to sail structure 210.

FIG. 5 shows a sectional view of a third embodiment of the present invention. Therein, a mast 312 having bolt rope groove 316 engages with a mast insert 340 having bolt rope connector 341 for engaging bolt rope groove 316. Mast insert 340 is made of a rigid or semi-rigid material and has a pair of bolt rope grooves 342, 344 which in turn engage with a pair of bolt ropes 314, 315 each attached to the leading edges of sail membranes 332, 334. As in the second embodiment, sail membranes 332, 334 extend the full chord length of the sail structure 310 and form a tapered sail cross section. Mast insert 340 extends the width W of mast 312 and is contoured, as shown, so that, at the locations of bolt rope grooves 342, 344, the insert 340 is in close proximity to mast 312. A series of stackable inserts 340 are stacked end-to-end and keyed to form a continuous insert structure having continuous bolt rope grooves 342, 344. Mast inserts 340 are mounted on mast 312 by inserting at an open end of mast 312 and sliding into place along bolt rope groove 316. As in the previous embodiments, a smoother flow transition is provided between mast 312 and sail structure 310, resulting in a more aerodynamic flow because of avoidance of a flow separation bubble.

FIG. 6 shows a sectional view of a fourth embodiment of the present invention. Mast 412 having bolt rope groove 416 is similar to that in the third embodiment, as are sail membranes 432, 434 comprising sail structure 410. Sail membranes 432, 434 respectively have bolt ropes 414, 415 which engage bolt rope grooves 442, 444 in mast insert 440. Mast insert 440 is continuous rather than stackable as in the third embodiment, but is similarly contoured as mast insert 340. A plurality of bolts illustrated by bolt 446 through mast insert 440 engage with bolt rope groove 416. Otherwise, operation of the embodiment is the same as in the third embodiment.

FIG. 7 shows a sectional view of a fifth embodiment of the present invention, which eliminates the need for an insert. Mast 512 includes bolt rope tracks 548, 550, extending along mast 512 and fastened as by countersunk bolts or screws 551 near the edge of mast 512. Bolt ropes 514, 515 on sail membranes 532, 534 of sail structure 510 engage bolt rope tracks 548, 550. The operation of this embodiment is similar to the third embodiment, in that the sail membranes 532, 534 are maintained separated so as to provide an aerodynamic transition from the mast 512.

FIG. 8 shows a sectional view of a sixth embodiment of the present invention. Mast 612 includes a pair of bolt rope grooves 616, 617. Bolt ropes 614, 615 on sail membranes 632, 634 of sail structure 610 engage bolt rope grooves 616, 617. The operation of this embodiment is the same as in the fifth embodiment.

The embodiments disclosed employ materials known in the sailcraft art. The masts are made of materials normally employed for that purpose. Similarly, the inflatable tubular inserts can be of fabric or plastic, sufficiently air tight to maintain an inflated structure under use. The semi-rigid inserts are also made of materials suitable for marine use. The source of air pressure to inflate the inflatable tube embodiments can be any standard means of inflation used in marine applications, including but not limited to a foot pump.

Although certain presently preferred embodiments of the invention have been described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A sail structure for a sailcraft with a mast having a leading edge, a trailing edge and a transverse dimension, said trailing edge having a vertical arranged bolt rope groove for receiving a bolt rope, said sail structure comprising:

a sail having at least two luff panels extending from said mast and converging at a distance from said mast, at least one insert for engaging said luff panels and said mast bolt rope groove so as to maintain a separation between said luff panels, and said separation corresponding substantially to said mast transverse dimensions, a central sail membrane to which said luff panels are attached, said insert comprising at last a pair of inflatable tubes each disposed between said central sail membrane and a respective luff panel, wherein, each luff panel is formed into a sleeve for receiving an inflatable tube, whereby an aerodynamic airflow is maintained along said mast and said luff panel.

2. A sail structure for a sail craft with a mast having a leading edge, a trailing edge, and a transverse dimension, said trailing edge having a vertical arranged bolt rope groove for receiving a bolt rope, said sail structure comprising:

a sail having at least two luff panels extending from said mast and converging at a distance from said mast, at least one insert for engaging said luff panels and sail mast bolt rope groove so as to maintain a separation between said luff panels, said separation corresponding substantially to said mast transverse dimension, a central sail membrane to which said luff panels are attached said insert comprising an inflatable tube creased longitudinally so as to form two inflatable chambers disposed between said luff panels, whereby an aerodynamic airflow is maintained along said mast and luff panels.

3. A sail structure for a sailcraft with a mast having a leading edge, a trailing edge, and a transverse dimension, said a trailing edge having a vertical arranged bolt rope groove for receiving a bolt rope, said sail structure comprising:

A sail having at least two luff panels extending from said mast and converging at a distance from said mast, at least one insert for engaging said luff panels and said mast bolt rope groove so as to maintain a separation between said luff panels, said separation corresponding substantially to said mast transverse dimension, a central cell membrane to which said luff panels are attached, said insert comprising at least a pair of inflatable tubes, each disposed between said central sail membrane and a respective luff panel, wherein said insert comprises an attachment for engaging said mast bolt rope groove, and having a pair of insert rope grooves for engaging a respective luff panel bolt rope, whereby an aerodynamic airflow is maintained along said mast and said luff panel.

4. A sail structure as in claim 3, wherein said insert attachment comprises a connector for engaging said bolt rope groove.

5. A sail structure as in claim 3, wherein said insert attachment comprises a bolt for engaging said bolt rope groove.

6. A sail structure as in claim 3, wherein a plurality of said inserts are provided, said inserts being located along the leading edge of said sail and being stackable and keyed to form a continuous insert structure.

7. A sail structure as in claim 3, wherein the insert attachment comprises connector for engaging said bolt rope groove.

8. A sail structure for a sail craft with a mast having a leading edge, a training edge, a training edge and a transverse dimension, said trailing edge having vertically arranged bolt groove for receiving a bolt rope, said sail structure comprising:

a sail having at least two luff panels extending from said mast and converging at a distance from said mast, a plurality of inserts for engaging said luff panels and said mass bolt rope groove so as to maintain a separation between said panels, said separation corresponding substantially to said mass traverse dimensions, said inserts being located along the leading edge of said sail and being stackable and keyed to form a continuous inert structure, whereby an aerodynamic airflow is maintained along said mast and luff panels.

* * * * *

UNITED STATES PATENT AND TRADEMARK OFFICE

CERTIFICATE OF CORRECTION

PATENT NO. : 5,347,946

DATED : September 20, 1994

INVENTOR(S) : Lawrence J. Puckett

It is certified that error appears in the above-indentified patent and that said Letters Patent is hereby corrected as shown below:

On the title page, insert after item [56] the following:

U. S. Patent Documents

| | | |
|---|---|---|
| 3,132,620 | 05/1964 | Court |
| 4,753,186 | 06/1988 | Paras |
| 3,391,668 | 07/1968 | Birchill |
| 4,947,776 | 08/1990 | Peterson |
| 4,741,282 | 05/1988 | Duke |
| 3,866,558 | 02/1975 | Bergstrom et al |
| 4,593,638 | 06/1986 | Cochran et al |
| 4,479,451 | 10/1984 | Lucht |
| 4,879,961 | 11/1989 | Aguilera |
| 4,803,939 | 02/1989 | Jones |
| 4,785,757 | 11/1988 | Ostholm |
| 4,646,671 | 03/1987 | Innes et al |
| 4,388,888 | 06/1983 | Gushurst, Jr. |

UNITED STATES PATENT AND TRADEMARK OFFICE

CERTIFICATE OF CORRECTION

PATENT NO. : 5,347,946
DATED : September 20, 1994
INVENTOR(S) : Lawrence J. Puckett It is certified that error appears in the above-indentified patent and that said Letters Patent is hereby corrected as shown below:

Other Publications

"Procyon: Creating new answers", SAIL, April 1990, pages 68-69

"A New Rising Star", SAILING WORLD, May 1990, pages 28-29.

"In the Pink" (undated, source unknown).

Signed and Sealed this

Twentieth Day of June, 1995

*Attest:*

Bruce Lehman

BRUCE LEHMAN

*Attesting Officer*

*Commissioner of Patents and Trademarks*